United States Patent [19]

Komori et al.

[11] 4,411,514

[45] Oct. 25, 1983

[54] VARIABLE MAGNIFICATION ELECTROPHOTOGRAPHIC COPYING APPARATUS

[75] Inventors: Shigehiro Komori; Hiroshi Ogawa, both of Yokohama, Japan

[73] Assignee: Canon Kabushiki Kaisha, Tokyo, Japan

[21] Appl. No.: 141,922

[22] Filed: Apr. 21, 1980

[30] Foreign Application Priority Data

Apr. 24, 1979 [JP] Japan ..... 54/51128
Oct. 23, 1979 [JP] Japan ..... 54/136839
Nov. 28, 1979 [JP] Japan ..... 54/154076

[51] Int. Cl.[3] ..... G03G 15/02

[52] U.S. Cl. ..... 355/14 CH; 355/3 CH; 355/8; 355/14 E

[58] Field of Search ..... 355/3 R, 3 CH, 8, 14 R, 355/14 CH, 14 E; 361/229, 230, 235

[56] References Cited

U.S. PATENT DOCUMENTS 3,496,351 2/1970 Cunningham ..... 355/3 CH X
3,564,239 2/1971 Kushima ..... 355/3 CH X
3,678,350 7/1972 Matsumoto et al. ..... 361/229
4,139,298 2/1979 Tani ..... 355/8
4,208,697 6/1980 Fischer et al. ..... 355/3 CH X
4,209,248 6/1980 Gibson et al. ..... 355/8

FOREIGN PATENT DOCUMENTS 49-29467 8/1974 Japan .
54-99634 8/1979 Japan ..... 355/3 CH

*Primary Examiner*—Fred L. Braun
*Attorney, Agent, or Firm*—Fitzpatrick, Cella, Harper & Scinto

[57] ABSTRACT

An electrophotographic apparatus capable of copying an original selectively at different magnifications includes a movable electrophotographic photosensitive member, an electrostatic discharge device for imparting discharge to the photosensitive member to render it into a potential condition capable of forming an electrostatic latent image, a scanning mechanism for scanning the original, an optical system for forming an optical image of the scanned original on the photosensitive member at a selected magnification to form an electrostatic latent image, a device for changing the velocity of movement of the photosensitive member in correspondence with the selected magnification, and control circuit for varying the quantity of discharge per unit time of the discharge member to the photosensitive member in correspondence with the selected magnification.

55 Claims, 14 Drawing Figures

VARIABLE MAGNIFICATION ELECTROPHOTOGRAPHIC COPYING APPARATUS

BACKGROUND OF THE INVENTION

1. Field of the Invention

This invention relates to an apparatus for forming copies through the steps of scanning an original and projecting the optical image of the original upon a movable electrophotographic photosensitive member, and more particularly to an electrophotographic apparatus capable of copying an original selectively at different magnifications.

2. Description of the Prior Art

Those of variable magnification electrophotographic copying apparatus of the original scanning type which have been put into practical use are constructed so that the velocity of a photosensitive member is the same for any copying magnification while the original scanning velocity is changed correspondingly to a selected magnification. Such apparatus have an advantage that copies can be obtained at the same speed for any copying magnification because the velocity of the photosensitive is invariable, while they also have various disadvantages. For example, in an apparatus wherein the one-to-one magnification copying at a magnification 1 and the reduced-scale copying at a magnification m ($m<1$) are possible, if the velocity of the photosensitive member is v for any magnification, the original scanning velocity during the one-to-one magnification copying is v but the original scanning velocity during the reduced-scale copying is v/m. That is, the original scanning velocity during the reduced-scale copying is greater than that during the one-to-one magnification copying. The most widely used original scanning device is of the type in which an original supporting table or mirrors are reciprocally moved along a straight guide path, but in such device, countermeasures must be taken against the shock and/or vibration of the device occurring at the time of starting or stoppage, because such shock and/or vibration would induce noise or failure of the copying apparatus and would also cause blur of the image. On the other hand, the above-described shock and/or vibration becomes greater as the scanning velocity is higher and therefore, the means for preventing such shock and/or vibration becomes bulky and also leads to increased cost.

Also, for example, in an apparatus wherein the one-to-one magnification copying at a magnification 1 and enlarged-scale copying at a magnification m' ($m'>1$) are possible, the original scanning velocity during the enlarged-scale copying is v/m' which is lower than that during the one-to-one magnification copying, but under-exposure occurs because the velocity of the photosensitive member is invariable. If the aperture of the lens is opened to prevent this, flare tends to occur to the image and, if the brightness of the original illuminating lamp is enhanced, there occurs an inconvenience that the amount of electric power consumed is increased. Also, the amount of under-exposure is not linearly varied for a variation in magnification and therefore, very much complicated means would be required to eliminate the under-exposure simply by adjusting the aperture and the lamp brightness.

In short, even a variable magnification copying apparatus is most frequently used for the one-to-one magnification copying. Accordingly, it would be most rational to construct the apparatus with the mechanical, electrical and physical requirements required for the one-to-one magnification copying being taken as the standard. However, in an apparatus wherein the velocity of the photosensitive member is the same for any copying magnification, there are many unreasonable or useless parts as viewed from the viewpoint of the one-to-one magnification copying and this has led to the bulkiness and complication of the apparatus as well as increased cost and deterioration of copy images. It has also led to a smaller degree of freedom with which the apparatus is constructed.

On the other hand, if design is made such that the velocity of movement of the photosensitive member is changed correspondingly to a change in copying magnification, the bulkiness and increased cost of the apparatus could be avoided and the construction of the apparatus having a reduced number of unreasonable or useless parts would become possible with the various requirements for the one-to-one magnification copying being taken as the standard, but if the velocity of movement of the photosensitive member is simply changed without any contrivance, deterioration of copy images would occur. This is because the speed at which image is formed on the photosensitive member is varied for each selected magnification.

SUMMARY OF THE INVENTION

It is an object of the present invention to provide a variable magnification electrophotographic copying apparatus which is simple in construction.

It is another object of the present invention to provide a variable magnification electrophotographic copying apparatus in which unreasonable or useless parts can be reduced in construction.

It is still another object of the present invention to provide a variable magnification copying apparatus having a great degree of freedom with which the apparatus is constructed.

It is yet still another object of the present invention to provide a variable magnification electrophotographic apparatus in which the velocity of movement of the photosensitive member is changed correspondingly to a selected magnification and which enables good images to be obtained.

The original scanning type variable magnification electrophotographic apparatus of the present invention is provided with a photosensitive member whose movement velocity is variable correspondingly to a selected magnification. The apparatus is further provided with control means for changing, correspondingly to a selected magnification, the quantity of discharge per unit time of discharge means which imparts discharge to the photosensitive member to render the photosensitive member into a potential condition capable of forming an electrostatic latent image. Accordingly, the image formation speed is varied in accordance with the selected magnification, but such variation in image formation speed may be compensated for by varying the quantity of discharge of the discharge means and good images can be obtained for any copying magnification. That is, by varying the quantity of discharge per unit time of the discharge means correspondingly to a change in movement velocity of the photosensitive member, good electrostatic latent image can be formed for any copying magnification.

The invention will become more fully apparent from the following detailed description thereof taken in conjunction with the accompanying drawings.

DETAILED DESCRIPTION OF THE PREFERRED EMBODIMENTS

Figure 1:
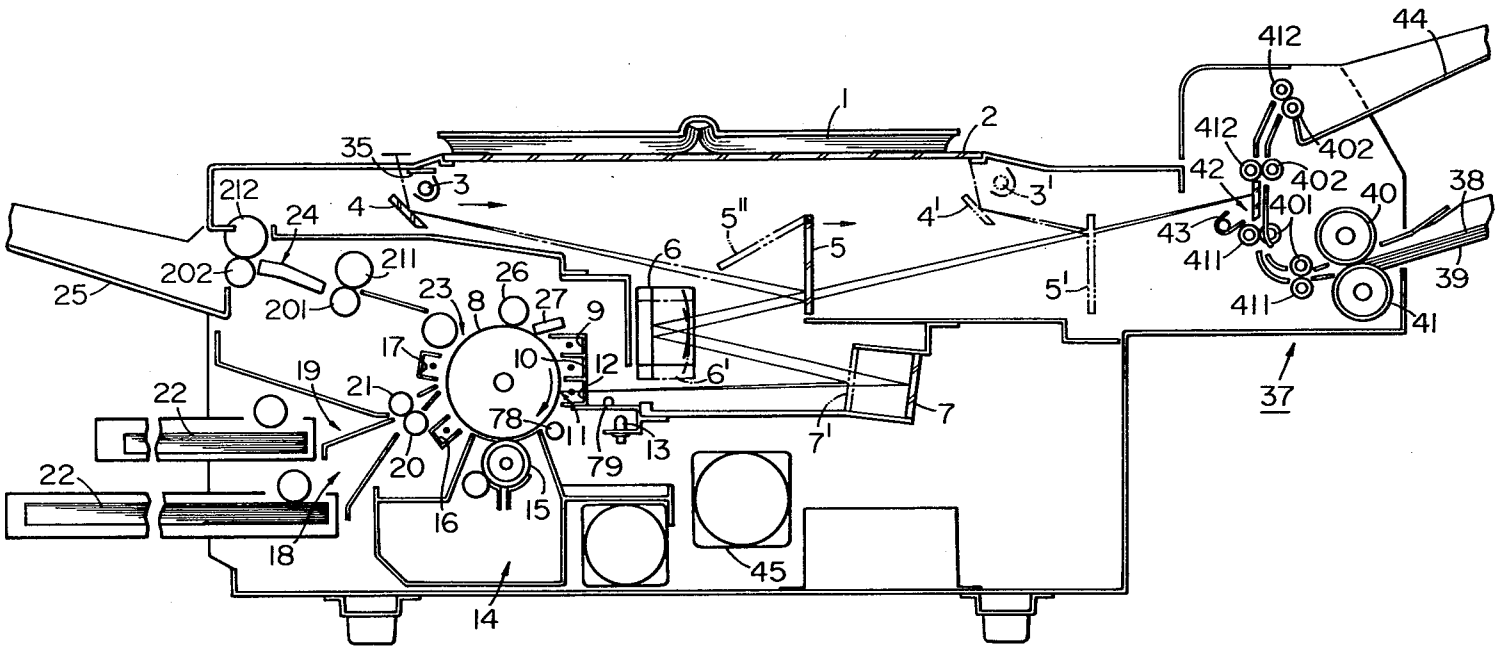
FIG. 1 is an illustration of a copying apparatus to which the present invention is applicable.

Referring to FIG. 1, a thick original 1 such as a book or the like is placed on a fixed original table 2 constituting an original supporting surface. This original is illuminated by an illuminating lamp 3 and is optically scanned by a first mirror 4 moved with the lamp 3 and parallel to the table 2 and a second mirror 5 moved at ½ of the velocity of the first mirror 4 in the same direction as the first mirror, and the image of the original is formed on a drum 8 rotated in the direction of arrow by an optical system comprising a stationary in-mirror type image forming lens 6 during the time other than the magnification changing operation or a stationary mirror 7 during the time other than the magnification changing operation. The surface of the drum 8 comprises an electrophotographic photosensitive member comprising an electrically grounded conductive layer, a photoconductive layer and a transparent surface insulating layer. With the rotation of this drum 8, corona discharge from a corona discharger 9 is first applied to the surface of the drum 8, whereby any change remaining on this surface is uniformly erased.

Subsequently, corona discharge from a DC corona discharger 10 is applied to the surface of the drum 8 to uniformly charge this surface. The discharge polarity of the discharger 10 is positive when said photoconductive layer is N-type, and negative when said photoconductive layer is P-type. Next, when the drum reaches an exposure station 11, the surface of the drum 8 is slit-exposed to the optical image of the original 1 as described previously and simultaneously therewith, corona discharge is applied from a corona discharger 12 to the surface of the drum. The discharger 12 is an AC corona discharger or a discharger of the opposite polarity to the discharger 10, but in any case, by the action of the dischargers 10 and 12 and the application of the said optical image, a potential pattern corresponding to the original is formed on the drum 8. Then, the drum 8 is uniformly exposed to the light from a lamp 13 and by this exposure, the aforementioned potential pattern is converted into an electrostatic latent image having a high contrast. The application of the discharge from the discharger 12 to the drum 8 may take place before the application of the optical image. In this case, the lamp 13 is unnecessary.

The electrostatic latent image formed on the drum 8 is developed into a visible image by a developing roller 15 disposed within a developing device 14 using a liquid developer and having a fog-preventing bias voltage applied thereto.

The latent image on the drum is usually visualized by the toner contained in the developer and, in order to increase the force with which the toner adheres to the drum surface, there is provided a post-charger 16 for imparting weak corona discharge to the drum surface immediately after the development to charge the drum surface.

The visible image on the drum is transferred onto copy paper 22 fed from a paper supply station 18 or 19 and transported by register rollers 20 and 21 so that the leading end of the copy paper is coincident with the leading end of the visible image on the drum. In order to enhance the image transfer efficiency, corona discharge is applied from a corona discharger 17 to the back side of the copy paper at the image transfer station. The copy paper having the visible image transferred thereto is separated from the drum at a separating station 23 and directed by rollers 211 and 201 to a fixing station 24, where the transferred image on the paper is fixed, where after the copy paper is discharged into a tray 25 by rollers 212 and 202. On the other hand, any developer remaining on the drum surface is removed therefrom by a roller 26 and a blade 27. Thereafter, the above-described image formation process may be repeated to provide a desired number of copies.

Figure 2:
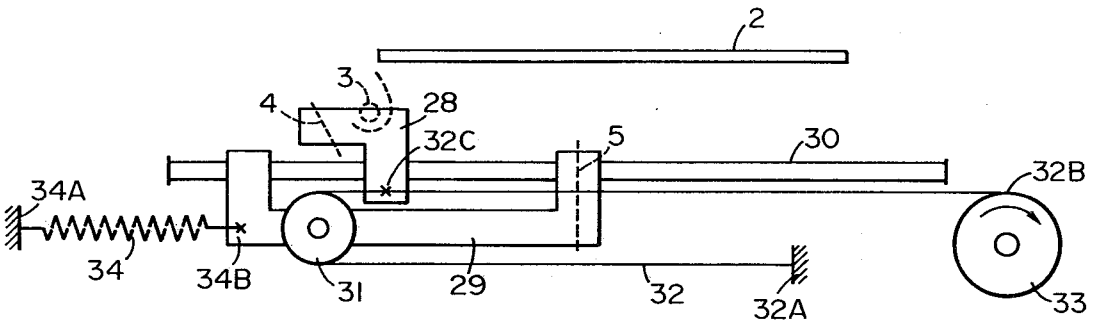
FIG. 2 is an illustration of a mirror driving mechanism.

The solid-line positions of the lamp 3, the first mirror 4 and the second mirror 5 indicate their start positions for the original scanning, and the dots-and-dash line positions 3', 4' and 5' indicate the positions in which they have scanned a maximum size of original. When they have scanned the original on the original table 2, the lamp 3 and the mirrors 4, 5 return from their positions 3', 4' and 5' to their said start positions. FIG. 2 shows a device for moving the lamp 3 and mirrors 4, 5. The lamp 3 and mirror 4 are supported by a first carriage 28 and the mirror 5 is supported by a second carriage 29. The carriages 28 and 29 in turn are slidably supported on a guide bar 30 parallel to the original table 2. Designated by 31 is a pulley rotatably supported on the second carriage 29. A wire 32 having one end 32A secured to an immovable member within the copying apparatus body passes over the pulley 31. The other end 32B of the wire 32 is secured to a drive pulley 33. The wire 32 is secured to the first carriage 28 at the portion 32C thereof between the pulleys 31 and 33. A spring 34 having one end 34A secured to an immovable member within the copying apparatus body has the other end 34B thereof retained on the second carriage 29. When the pulley 33 is rotated in the direction of arrow by receiving the rotative drive force of a motor through a clutch, it pulls on the wire 32, so that the first and second carriages 28 and 29 are rightwardly moved parallel to the table 2 at a speed ratio of ½. Accordingly, the lamp 3 and mirrors 4, 5 are rightwardly moved to scan the original, as already described. When the original scanning is terminated, the clutch becomes inoperative and the first and second carriages 28 and 29 are returned to their forward movement start positions by the force of the spring 34 extended during the forward movement of the second carriage 29. Thus, the lamp 3 and mirrors 4, 5 are returned to their forward movement start positions.

Description will now be made of an automatic sheet original feeding portion 37. When a sheet original copy instruction comes in, the first mirror 4 and the second mirror 5 are forwardly moved over a small distance to a position capable of exposing the drum 8 to the image of a standard white plate 35 to be described and, when the exposure is terminated, the mirrors are returned to their start positions. (During the copying of the original placed on the table 2, the drum is exposed to the image of the white plate 35 after the mirrors 4, 5 have started their forward movement for the original scanning and before the scanning of the original 1 is started. By such exposure of this standard white plate 35, the bias value of the developing roller 15 is set as will later be described.) Thereafter, the second mirror 5 is displaced to the position 5″ in FIG. 1 and the optical path for the exposure of the image of the original on the original table 2 is eliminated while, at the same time, the optical path for the exposure of the image of the sheet original is formed. Sheet originals 38 are fed one by one by feed rollers 40 and 41. The sheet original fed by the feed rollers 40 and 41 is conveyed by rollers 401 and 412 and comes into a window portion 42 opposed to the lens 6, and is illuminated by an illuminating lamp 43 and the image thereof is slit-projected onto the drum 8 at the exposure station 11 through an optical path comprising the in-mirror lens 6 and stationary mirror 7. That is, the sheet original is conveyed through the window portion 42, whereby it is optically scanned. Thereafter, the sheet original is conveyed by rollers 402 and 412 and discharged into a tray 44. When all sheet originals 38 have been copied, the second mirror is returned from the position 5″ to the position 5. Again in the case of the copying using the automatic original feeding device (ADF) 37, the operations of the means 9–25 are of course the same as the case where the original 1 placed on the table 2 is copied.

In the above-described apparatus, when a reduced-scale copy instruction is given by a copy button or the like (not shown), an in-mirror 6′ is selected instead of the in-mirror lens 6, which is moved toward this side (or the rear) in the drawing, and the in-mirror type image forming lens 6′ having a focal length different from that of the lens 6 is disposed in the optical path. That is, the in-mirror lenses 6 and 6′ are fixed to a member movable in a direction perpendicular to the plane of the drawing sheet. In the present embodiment, the in-mirror surfaces of the in-mirror lenses 6 and 6′ are coplanar and the center of the optical path of the in-mirror lens 6′ is disposed so as to lie slightly below the in-mirror lens 6. Simultaneously with the interchange of the in-mirror lens, the stationary mirror 7 comes to a position 7′ while keeping its mirror surface parallel, in order to change the length of the optical path from the length for one-to-one magnification copying to the length for reduced-scale copying. Thus, the optical system for reduced-scale copying of the original on the original table 2 is formed by the first mirror 4, second mirror 5, in-mirror lens 6′ and the stationary mirror displaced to the position 7′, and the optical system for reduced-scale copying during the use of the sheet original feeding device 37 is formed by the in-mirror lens 6′ and stationary mirror 7′ when the mirror 5 has been pivoted to a position 5″. The quantity of light during the one-to-one magnification copying and the quantity of light during the reduced-scale copying, both at the exposure station 11, can be made equal to each other by selecting the F-value of the in-mirror lens 6′ to a value smaller than the F-value of the in-mirror lens 6.

Now, the velocity V at which the sheet original 38 is conveyed through the window portion 42 by said conveyor rollers (the sheet original scanning velocity V) is equal to the velocity V at which the original 1 on the table 1 is scanned (the forward movement velocity V of the first mirror 4). Also, both the scanning velocity V of the original 1 and the scanning velocity V of the original 38 are identical irrespective the copying magnification selected. That is, the conveyor rollers 40, 41, 401, 411, 402, 412 of the ADF 37 and the pulley 33 of FIG. 2 are rotatively driven at the same peripheral velocity for any copying magnification. However, the peripheral velocity of the photosensitive drum 8 is changed in accordance with the copying magnification selected.

That is, during the one-to-one magnification copying, the peripheray velocity of the drum 8 is the velocity V equal to the original scanning velocity V, but during the reduced-scale copying, the peripheral velocity of the drum 8 is changed to the original scanning velocity multiplied by the reduced-scale copying magnification m ($m<1$), namely, a velocity lower than the peripheral velocity during the one-to-one magnification copying. At the same time, the copy paper conveyance velocity of the device for conveying copy paper 22, for example, the rollers 20, 21, etc., is changed from the velocity for the one-to-one magnification copying to the velocity for the reduced-scale copying. Both during the one-to-one magnification copying and the reduced-scale copying, the conveyance velocity of the copy paper 22 is equal to the peripheral velocity of the drum 8.

Figure 3:
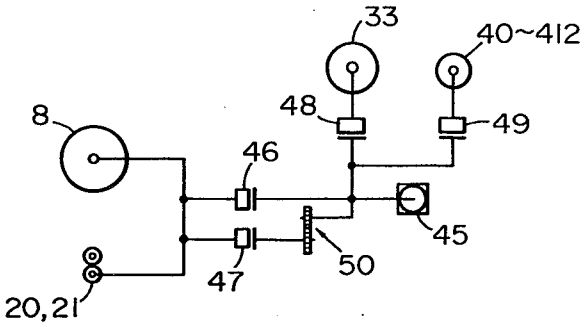
FIG. 3 illustrates an example of the velocity change-over mechanism.

Referring to FIG. 3, reference numerals 46, 47, 48 and 49 designate clutches and reference numeral 50 denotes a reduction gear train. When the original 1 placed on the table 2 is to be copied, clutch 48 is operated to transmit the rotative drive force of motor 45 to the pulley 33, whereby the original 1 is scanned at the velocity V. When sheet original 38 is to be copied by the use of the ADF 37, clutch 49 is operated to transmit the rotative drive force of motor 45 to the original conveyor rollers 40, 41, 401, 411, 402 and 412, whereby the sheet original 38 is scanned at the velocity V. During the one-to-one magnification copying clutch 46 is operated to transmit the rotative drive force of motor 45 to the drum 8 and the copy paper conveyor rollers 20, 21, whereby the means 8, 20 and 21 are rotated at the peripheral velocity 1X, V, namely, V. Next, during the reduced-scale copying at magnification m, clutch 47 is operated. Accordingly, the rotative drive force of motor 45 is transmitted to the drum 8 and rollers 20, 21 through reduction gear 50 and clutch 47. Accordingly, the drum 8 and rollers 20, 21 are rotated at a peripheral velocity mV. In FIG. 3, the lines passing through the numbered means show a well-known power transmission mechanism comprising a gear train, chain, sprocket, etc. In such a copying apparatus provided with an ADF in addition to the means for scanning the original placed on the original table 2, the number of clutches used can be reduced by designing the apparatus so that the velocity of the photosensitive member is changed when the copying magnification is changed, and therefore the failure of the copying apparatus may be reduced. If the velocity of the photosensitive member is made invariable and the velocities of the pulley 33 and rollers 40, 41, 401, 412, 402, 412 are made variable in accordance with the magnification selected, the number of velocity changing clutches will be increased.

Now, in the above-described copying apparatus, the quantities of corona discharge per unit time of the corona dischargers 10 and 12 for rendering the photosensitive member into a potential condition capable of forming an electrostatic latent image are varied correspondingly to the selected copying magnification, in other words, correspondingly to the selected velocity of the photosensitive member, whereby the light portion potential and dark portion potential of the electrostatic image are maintained constant irrespective of the selected copying magnification. The light portion potential refers to the surface potential of the area of the electrostatic image to which the developer should not adhere, and the dark portion potential refers to the surface potential of the area of the electrostatic image to which the developer should adhere. Accordingly, where a positive copy image of an original having characters printed in black ink on a white ground is to be formed, the surface potential of the area of the electrostatic image which corresponds to the white ground is the light portion potential and the surface potential of the area of the electrostatic image which corresponds to the characters is the dark portion potential.

Figure 4:
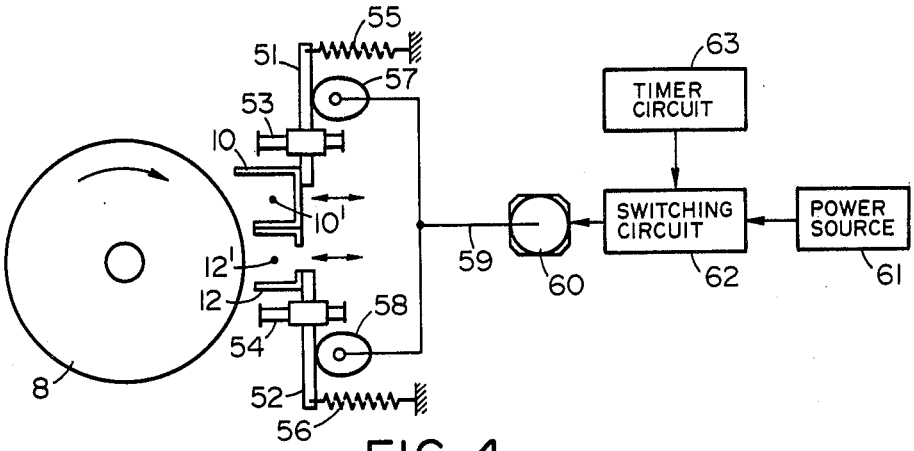
FIG. 4 illustrates an example of the discharge amount change-over device.

That is, in FIG. 4, the same voltage for any copying magnification is applied to the discharge electrodes 10' and 12' of the dischargers 10 and 12, respectively. Adjust members 51 and 52 are secured to the dischargers 10 and 12, respectively. The adjust members 51 and 52 are slidably supported on guide rails 53 and 54, respectively. Also, the adjust members 51 and 52 are caused to bear against cams 57 and 58 by springs 55 and 56, respectively. Accordingly, rotation of the cams 57 and 58 causes the dischargers 10 and 12 to move in the directions of arrows. The cams 57 and 58 are rotated by the rotational force of motor 60 being transmitted to a gear train 59. On the other hand, there is a switching circuit 62 between the motor 60 and its driving powr source 61, and the switching circuit 62 is controlled by a timer circuit 63 which is operated by magnification changing operation. When a magnification changing operation takes place, the timer circuit 63 is operated to close the switchng circuit 62 for a predetermined time, whereby the motor 60 is electrically energized and effects a predetermined number of revolutions. Thus, the cams 57 and 58 are rotated through 180°. By this rotation of the cam 57, the distance between the discharger 10 and the surface of the drum 8 is changed to a distance corresponding to the selected magnification, and by the rotation of the cam 58, the distance between the discharger 12 and the surface of the drum 8 is changed to a distance corresponding to the selected magnification. The distances between the dischargers 10, 12 and the photosensitive surface of the drum 8 during the reduced-scale copying are larger than the distances between the dischargers 10, 12 and the surface of the drum 8 during the one-to-one magnification copying. In any case, when the distances between the dischargers 10, 12 and the surface of the drum 8 are changed, the intensities of the electric fields between the dischargers 10, 12 and the surface of the drum 8 are varied, so that the quantities of discharge per unit time of the dischargers 10 and 12 are varied in correspondence with the selected magnification. In other words, the quantity of discharge per unit area which the surface of the drum 8 receives from the dischargers 10 and 12 is substantially constant irrespective of the selected magnification. Accordingly, the light portion potential and dark portion potential of the electrostatic image are maintained constant for any copying magnification. Or, even if the light portion potential and dark portion potential of the electrostatic image are varied with a change of the copying magnification, the amounts of variation can be minimized to a negligible degree of the above-described control of the quantities of discharge. Therefore, for any copying magnification, there may be obtained a copy image which is clear and good in contrast and tone gradation.

Figure 5:
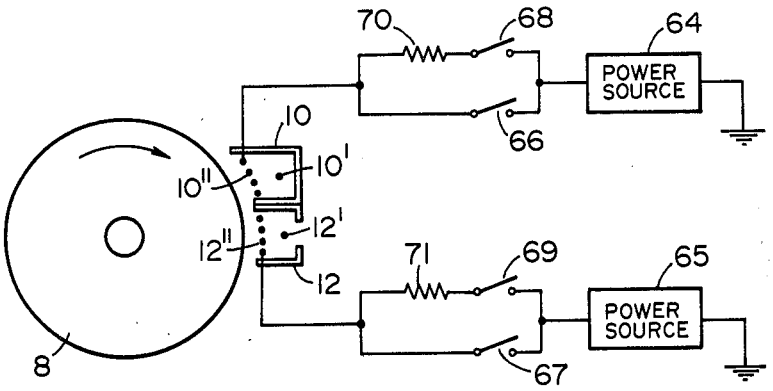
FIG. 5 illustrates another example of the discharge amount change-over device.

In the embodiment of FIG. 5, corona dischargers 10 and 12 have grids 10" and 12", respectively, in their discharge current passage openings. Bias voltages are applied from bias voltage sources 64 and 65 to the grids 10" and 12", respectively. The values of the bias voltages applied to the grids 10" and 12" are changed in accordance with the selected copying magnification. During the one-to-one magnification copying, switches 68 and 69 are closed and resistors 70 and 71 are interposed between the grid 10" and the power source 64 and between the grid 12" and the power source 65, respectively. On the other hand, during the reduced-scale copying, switches 66 and 67 are closed and the voltages of the power sources 64 and 65 are applied to the grids 10" and 12" not through the resistors 70 and 71. In this manner, the quantity of discharge per unit time applied to the surface of the drum 8 through the discharge openings of the dischargers 10 and 12 varies correspondingly to the selected magnification. In other words, the quantity of discharge per unit time applied from the dischargers 10 and 12 to the surface of the drum 8 is smaller during the reduced-scale copying than during the one-to-one magnification copying, whereby the light portion potential and dark portion potential of the electrostatic image are maintained substantially constant irrespective of any variation in velocity of the photosensitive member, as already noted. In the embodiment of FIG. 5, the voltages applied to discharge electrodes 10' and 12' are constant irrespective of the selected copying magnification.

Figure 6:
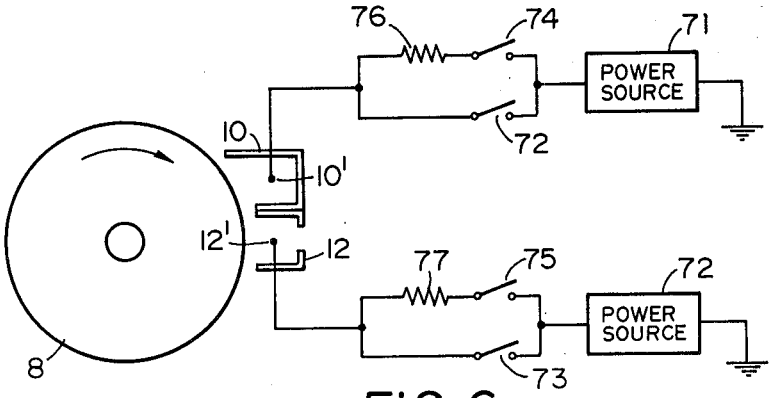
FIG. 6 illustrates still another example of the discharge amount change-over device.

In the embodiment of FIG. 6, the voltages applied to the corona discharging electrodes of discharges 10 and 12 are changed in accordance with the selected magnification. That is, corona discharge voltages are applied from power sources 71 and 72 to the discharging electrodes 10' and 12' of the dischargers 10 and 12, respectively. During the reduced-scale copying, switches 74 and 75 are closed and a resistor 76 is interposed between the electrode 10' and the power source 71 and a resistor 77 is interposed between the electrode 12' and the power source 72. On the other hand, during the one-to-one magnification copying, switches 72 and 73 are closed and the voltages from the power sources 71 and 72 are applied to the electrodes 10' and 12', respectively, not through the resistors 76 and 77. Accordingly, the quantity of corona discharge per unit time applied from the dischargers 10 and 12 to the surface of the drum 8 is smaller during the reduced-scale copying than during the one-to-one magnification copying. In any case, the quantity of discharge per unit time of the dischargers 10 and 12 is changed correspondingly to a change in velocity of the photosensitive member and therefore, as previously described, the light portion potential and dark portion potential of the electrostatic image are maintained substantially constant irrespective of the selected magnification.

Figure 7:
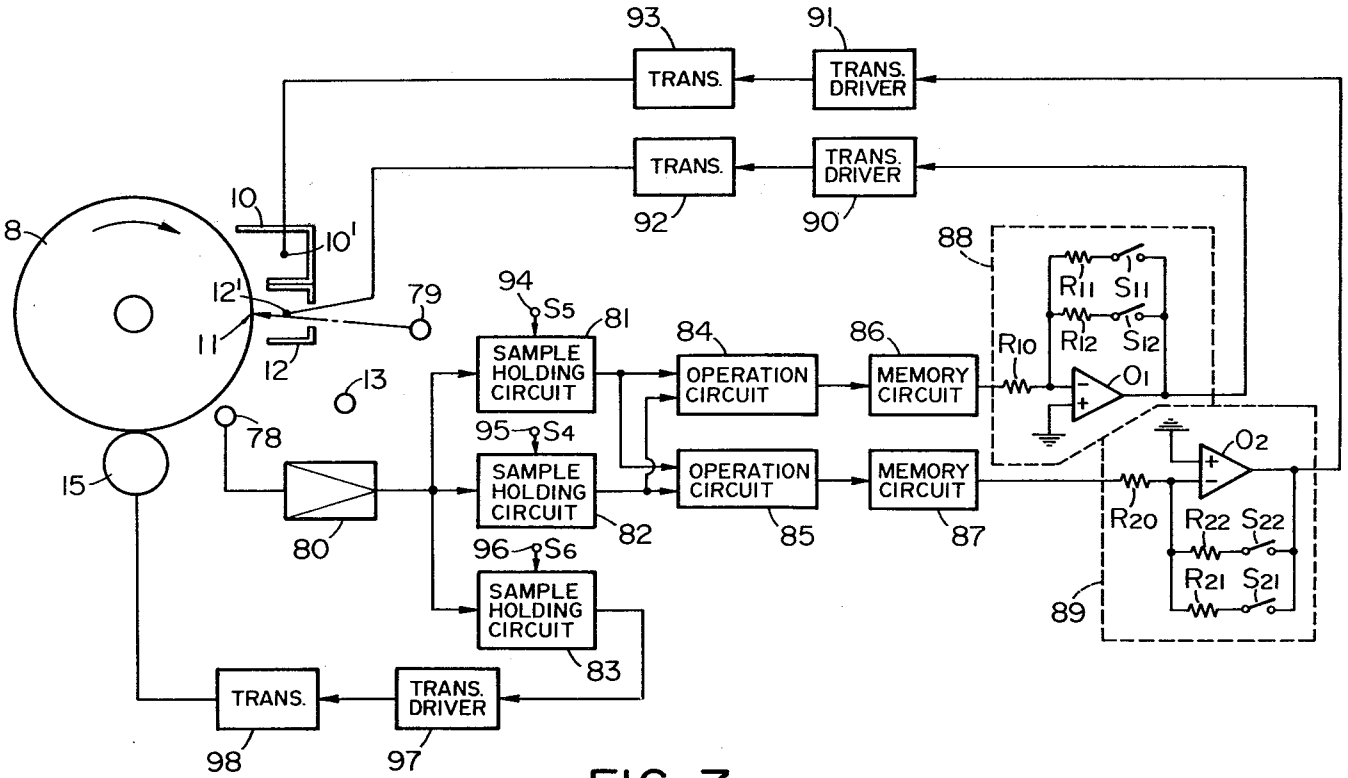
FIG. 7 illustrates yet still another example of the discharge amount change-over device.

Incidentally, the light portion potential and dark portion potential of the electrostatic image may sometimes be varied by environmental conditions surrounding the drum 8, such as humidity, temperature, etc. The embodiment of FIG. 7 is one in which such varation is prevented so that very good images can be obtained. Designated by 78 is a surface potential detector disposed in proximity to the surface of the drum 8 after it has been uniformly illuminated by lamp 13, in other words, after an electrostatic image has been formed thereon. Designated by 79 is a lamp which is turned on when the original illuminating lamp 3 is turned off and the original image is not projected upon the drum 8. The light emitted from the lamp 79 passes through the optical slit opening of discharger 12 to the surface of the drum 8 at the exposure station 11. Simultaneously therewith, the surface of the drum 8 is also subjected to the corona discharge of the discharger 12 and so, by the turn-on of the lamp 79, the whole surface of the drum 8 provides a light portion potential and on the other hand, when both of the lamps 3 and 79 are turned off, the whole surface of the drum 8 provides a dark portion potential.

Now, in FIG. 7, reference numeral 80 designates an amplifier circuit, reference numerals 81, 82 and 83 denote sample holding circuits, reference numerals 84 and 85 designate operation circuits, reference numerals 86 and 87 denote memory circuits, reference numerals 88 and 89 designate output changing circuits, reference numerals 90 and 91 denote transformer driver circuits, and reference numerals 92 and 93 designate transformers for applying discharge voltages to electrodes 10' and 12', respectively. Reference numeral 94 designates a $V_D$ strobe signal input terminal, reference numeral 95 denotes a $V_{L1}$ strobe signal input terminal, and reference numeral 96 designates a $V_{L2}$ strobe signal input terminal.

Figure 8:
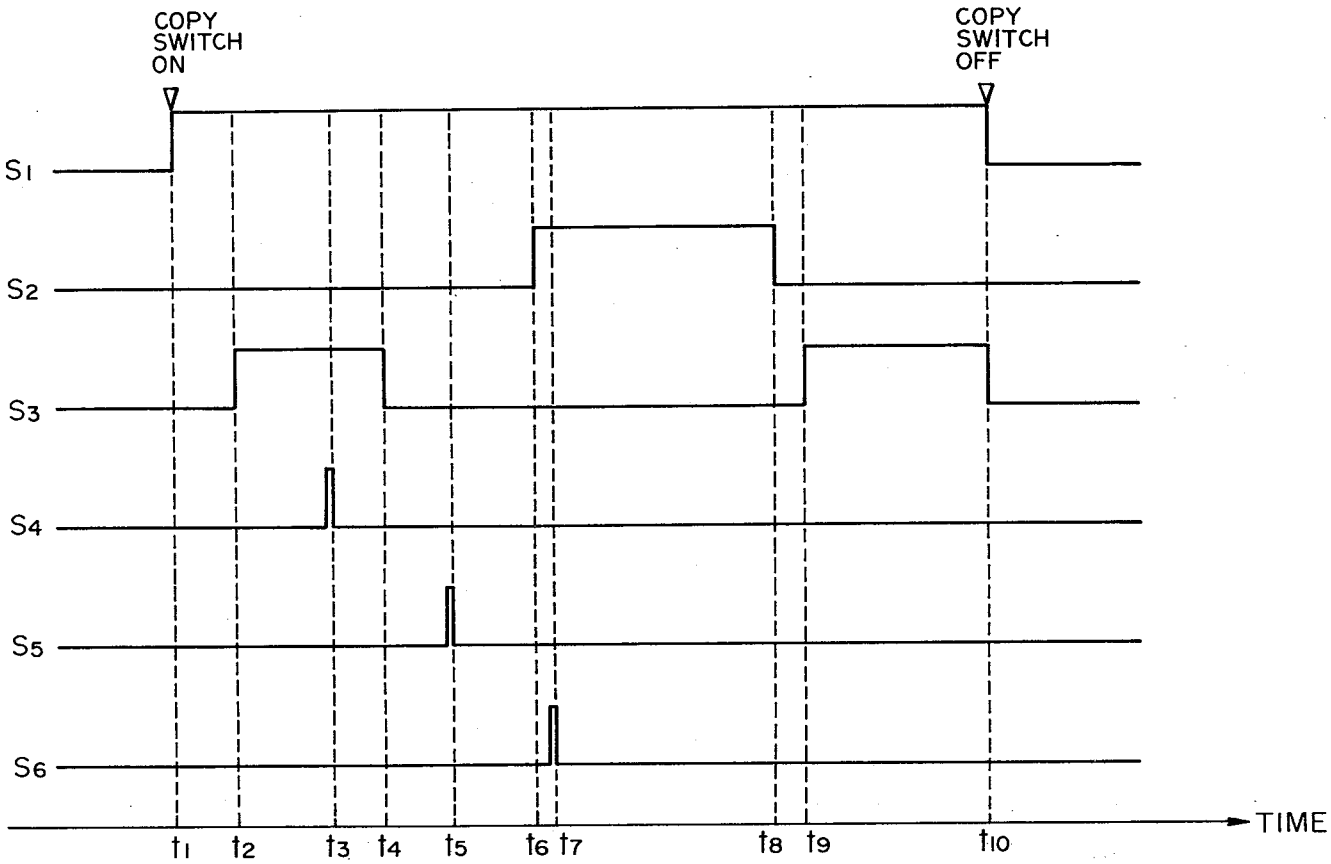
FIG. 8 illustrates the operation of a copying apparatus using the device of FIG. 7.

Reference is now had to FIG. 8 to describe the operation of the circuit of FIG. 7. In FIG. 8, $S_1$ is a rotative drive signal for the drum 8. By this signal $S_1$, one of the clutches 46 and 47 of FIG. 3 which corresponds to the selected magnification is operated and the drum 8 is rotated at a velocity corresponding to the selected magnification. $S_2$ is a forward movement signal for the mirrors 4 and 5. By this signal $S_2$, the clutch 48 of FIG. 3 is operated and the drive pulley 33 is located. Also, by the use of this signal $S_2$, the original illuminating lamp 3 is turned on. Accordingly, the lamp 3 is turned on upon start of the forward movement of the mirrors 4 and 5 and continues to be turned on until the forward movement is terminated. $S_3$ is a turn-on signal for the lamp 79, $S_4$ is $V_{L1}$ strobe signal, $S_5$ is $V_D$ strobe signal and $S_6$ is $V_{L2}$ strobe signal. The dischargers 10, 12 and lamp 13 of FIG. 7 are adapted to effect the aforementioned operations by the signal $S_1$. That is, the dischargers 10, 12 and lamp 13 start to effect their operations simultaneously with the rotation of the drum 8 and continue their operations until the rotation of the drum 8 is stopped.

Now, the surface potential of the drum 8 is detected by a potentiometer 78 and applied through a measuring circuit 80 to the sample holding circuits 81, 82 and 83. The sample holding circuits 81, 82 and 83 convert the then input signal voltage into a direct current and memorize the same at time points $t_5$, $t_3$ and $t_7$ whereat the $V_D$ strobe signal $S_5$, $V_{L1}$ strobe signal $S_4$ and $V_{L2}$ strobe signal $S_6$ have been put out.

When copy switch is closed at time $t_1$, the drum 8 starts rotating by the signal $S_1$ and simultaneously therewith, preset reference currents flow to the electrodes 10' and 12', so that the dischargers 10 and 12 start discharging while, at the same time, lamp 13 is turned on. Next, at time $t_2$, lamp 79 is turned on and a light portion potential is formed on the surface of the drum 8. The light portion potential formed by the turn-on of the lamp 79 is memorized by the sample holding circuit 82 at time $t_3$ in accordance with the strobe signal $S_4$. Next, at time $t_4$, the lamp 79 is turned off and a dark portion potential is formed on the surface of the drum 8. The dark portion potential formed by the turn-off of the lamp 79 is memorized by the sample holding circuit 81 at time $t_5$ in accordance with the strobe signal $S_5$. The signals memorized by the circuits 81 and 82 are applied to the operation circuits 84 and 85.

Here, the operation circuit 84 carries out an operation in accordance with an equation $$I_{10}=\alpha_1\cdot\Delta V_D+\alpha_2\cdot\Delta V_L+I'_{10}$$

and puts out a signal corresponding to a current value which is to be flowed to the electrode 10' of the discharger 10. Also, the operation circuit 85 carries out an operation in accordance with an equation $$I_{12}=\beta_1\cdot\Delta V_D+\beta_2\cdot\Delta V_L+I'_{12}$$

and puts out a signal corresponding to a current value which is to be flowed to the electrode 12' of the discharger 12. $\Delta V_D$ represents the difference between the aimed-at dark portion potential and the dark portion potential actually detected by the potentiometer 78, and $\Delta V_L$ represents the difference between the aimed-at light portion potential and the light portion potential actually detected by the potentiometer 78. $I'_{10}$ is the reference current value which has actually flowed to the electrode 10' when the drum surface potential has been detected by the potentiometer 78, and $I'_{12}$ is the reference current value which has actually flowed to the electrode 12' when the drum surface potential has been detected by the potentiometer 78. $\alpha_1$ is the inverse number of the rate of the dark portion potential variation to the current variation flowing to the electrode 10', $\alpha_2$ is the inverse number of the rate of the light portion potential variation to the current variation flowing to the electrode 10', $\beta_1$ is the inverse number of the rate of the dark portion potential variation to the current variation flowing to the electrode 12', and $\beta_2$ is the inverse number of the rate of the light portion potential variation to the current variation flowing to the electrode 12'.

The outputs of the operation circuits 84 and 85 are memorized by the memory circuits 86 and 87, respectively. These memory circuits 86 and 87 are set by the signal inputs from the operation circuits 84 and 85, and reset by opening of copy switch. In any case, the circuits 86 and 87 apply their memorized signals to the output changing circuits 88 and 89.

The circuit 88 comprises an operational amplifier $O_1$, resistors $R_{10}$, $R_{11}$, $R_{12}$, and switches $S_{11}$, $S_{12}$, and the circuit 89 comprises an operational amplifier $O_2$, resistors $R_{20}$, $R_{22}$, $R_{21}$, and switches $S_{21}$, $S_{22}$. The ratio of the output signal value to the input signal value to the circuit 88 is determined by the ratio of the resistor $R_{11}$ or $R_{12}$ to the resistor $R_{10}$ and likewise, the ratio of the output signal value to the input signal value to the circuit 89 is determined by the ratio of the resistor $R_{21}$ or $R_{22}$ to the resistor $R_{20}$. The transformer driver circuit 90 controls the output of the transformer 92 correspondingly to the output signal value of the circuit 88 and likewise, the transformer driver circuit 91 controls the output of the transformer 92 correspondingly to the output signal value of the circuit 89. Thus, during the one-to-one magnification copying, the switches $S_{11}$ and $S_{21}$ are closed and the correction current values to be flowed to the electrodes 12' and 10' are caused to correspond to the one-to-one magnification copying. Also, during the reduced-scale copying, the switches $S_{12}$ and $S_{22}$ are closed and the correction current values to be flowed to the electrodes 12' and 10' are caused to correspond to the reduced-scale copying.

By the circuits 88 and 89, a current corresponding to the selected magnification flows to the electrodes 10' and 12' of the dischargers 10 and 12 and moreover, this current is finely adjusted by the use of a means comprising members 78 to 87. Accordingly, the quantity per unit time of the corona discharge current applied to the photosensitive drum 8 by the dischargers 10 and 12 is varied correspondingly to the velocity of the photosensitive member resulting from the magnification change and is also finely adjusted for variations in environmental conditions such as temperature, humidity, etc., and therefore a very good electrostatic latent image may always be formed on the photosensitive drum 8.

In FIG. 7, reference numeral 98 designates a transformer for applying a fog preventing bias voltage to the developing electrode 15. The transformer 98 is controlled by the transformer driver circuit 97. This circuit 97 in turn is controlled by the output of the sample holding circuit 83. The sample holding circuit 83 memorizes the surface potential of the drum 8 detected by the potentiometer 78 at a point of time whereat the signal $S_6$ has been generated. This strobe signal is generated after time $t_6$ when the mirrors 4 and 5 have started their forward movement from their forward movement starting points by the strobe signal $S_2$. More particularly, the mirrors 4 and 5 scans the standard white plate 35 after having started their forward movement and immediately before beginning to scan the original 1. Accordingly, the light image of the white plate 35 is formed on the drum 8 immediately before the image of the original is projected thereupon. Therefore, a latent image (having a light portion potential) of the white plate 35 is formed on the drum 8 and, at a point of time whereat this latent image has reached the position of the potentiometer 78, the signal $S_6$ is generated. Thus, the latent image potential of the white plate 35 is memorized in the circuit 83 and, by the circuit 97 being controlled by this memorized signal, a bias voltage for preventing toner from adhering to the drum surface portion having the same potential as this latent image is applied to the developing electrode 15. Thus, even if the copying magnification is changed and further the said environmental conditions are varied, there can always be obtained a fogless beautiful copy. The white plate 35 has a light reflecting characteristic equivalent to that of a standard white original.

In FIG. 8, the scanning of the original is terminated at time $t_8$, the lamp 79 is again turned on at time $t_9$, and the copy switch is opened at time $t_{10}$ to stop the rotation of the drum 8 and turn off the lamp 79.

As the means for forming the signal applied to the circuits 88 and 89, use may also be made of the control means described in U.S. application Ser. No. 68,416 (filed Aug. 21, 1979), now abandoned, corresponding to German Application No. P2934337.1 (filed Aug. 24, 1979). Also, as the control means for controlling the bias voltage applied to the developing electrode 15, use may be made of the means described in the same U.S. application.

Figure 9:
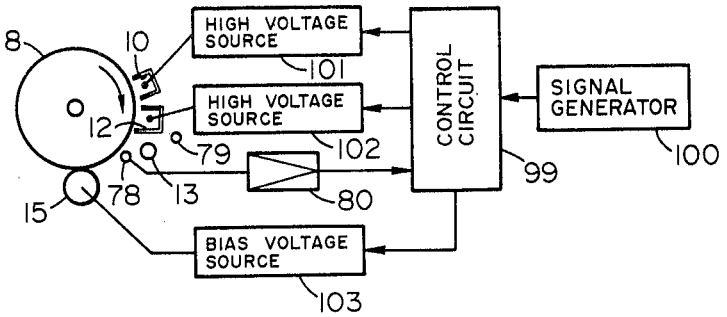
FIG. 9 illustrates another example of the discharge amount change-over device.

Also, in the manner as shown in FIG. 9, the quantities of discharge per unit time of the dischargers 10 and 12 may be controlled in accordance with the change in velocity of the photosensitive member resulting from a change in magnification and variations in environmental conditions. Again in this example, as described in connection with FIGS. 7 and 8, the surface potential of the photosensitive drum 8 is measured by the surface potentiometer 78 during the prerotation of the drum (the period from time $t_1$ to time $t_6$) and it is fed back to the dischargers 10 and 12 and corrected, whereby the surface potential of the drum when exposed to the image of the original is secured within a predetermined level.

Now, in FIG. 9, a reference current is flowed to the primary charger 10 and deelectrifier 11 while the drum 8 is effecting pre-rotation at a velocity corresponding to the selected copying magnification, whereby the light portion potential and dark portion potential of the drum surface are alternately measured by the potentiometer 78. When the light portion potential is being measured, the lamp 79 is turned on and, when the dark portion potential is being measured, the lamp 79 is turned off. Signals representing the light portion potential and dark portion potential detected by the potentiometer 78 are amplified by an amplifier circuit 80 and enter an operation control circuit 99. In the control circuit 99, the signal of a target potential constant signal generating circuit 100 set correspondingly to the selected magnification is compared with the signal detected by the potentiometer 78 and the difference therebetween is calculated and a correction current calculated in accordance with a preset correction formula is added to the reference current. This added current is applied to the discharger 10 and discharger 12 through a high voltage source 101 for discharger 10 and a power source 102 for deelectrifier. Thus, of the current comprising the correction current added to the reference current, the component corresponding to the dark portion potential is applied to the discharger 10 and the component corresponding to the light portion potential is applied to the discharger 12. The current comprising the correction current added to the reference current provides the reference current during the next control (during the next drum pre-rotation). After the above-described control has been rotated during the pre-rotation of the drum, the surface potential of the drum 8 finally comes into apredetermined level. After this condition has been brought about, the scanning of the original and the projection of the image thereof onto the photosensitive member at the selected magnification are started.

In said control device, the signal of the target potential constant signal generating means 100 is changed in accordance with the copying magnification. That is, this signal is changed so that during the reduced-scale copying when the velocity of the photosensitive member is slow as described, the voltage applied to the corona dischargers 10 and 12 becomes lower by a value corresponding to the reduced-scale magnification than during the one-to-one magnification copying. In this way, both during the one-to-one magnification copying and the reduced-scale copying, the light portion potential of the latent image for the same original is a light portion potential and the dark portion potential of the latent image is a dark portion potential and they respectively come into predetermined level ranges, thus ensuring a good copy image to be obtained.

In FIG. 9, both in the case where the original on the table 2 is to be copied and the case where the original fed by the feed device 37 is to be copied, the standard white plate 35 is illuminated by the lamp 3 immediately before the original is scanned to expose the photosensitive member to the image of the original, to thereby impart a standard exposure amount to the photosensitive member, and the then surface potential is measured by sensor 28, and for this measured value, a voltage of a value which will not cause fog on the drum during development is calculated by the control circuit 99 and imparted to the developing roller 15 through a development bias voltage source 103. Such development bias control is effected both during the one-to-one magnification copying and the reduced-scale copying.

The above-described embodiments are designed such that one kind of reduced-scale copying can be effected relative to one-to-one magnification copying, whereas the present invention is not restricted thereto but two or more kinds of reduced-scale copying are possible or, if the construction of the optical system or the like is changed, stageless reduced-scale copying will also be possible. Further, the above-described embodiments may also be designed such that enlarged-scale copying can be effected. In this case, if the enlarged-scale copying magnification is m′ (M′>1), the velocity of the photosensitive member will be m′. V during the enlarged-scale copying and this is higher than during the one-to-one magnification copying and therefore, the quantities of discharge per unit time of the dischargers 10 and 12 will be increased as compared with the quantities of discharge during the one-to-one magnification copying. In any case, for the original scanning velocity V, the photosensitive member will be rotated at a peripheral velocity obtained by multiplying V by a selected magnification.

Now, by changing the velocity of the photosensitive member when the copying magnification is changed, the amount of original image exposure received by unit area of the photosensitive member may be maintained constant with greater ease. Such embodiment will hereinafter be described.

Figure 10:
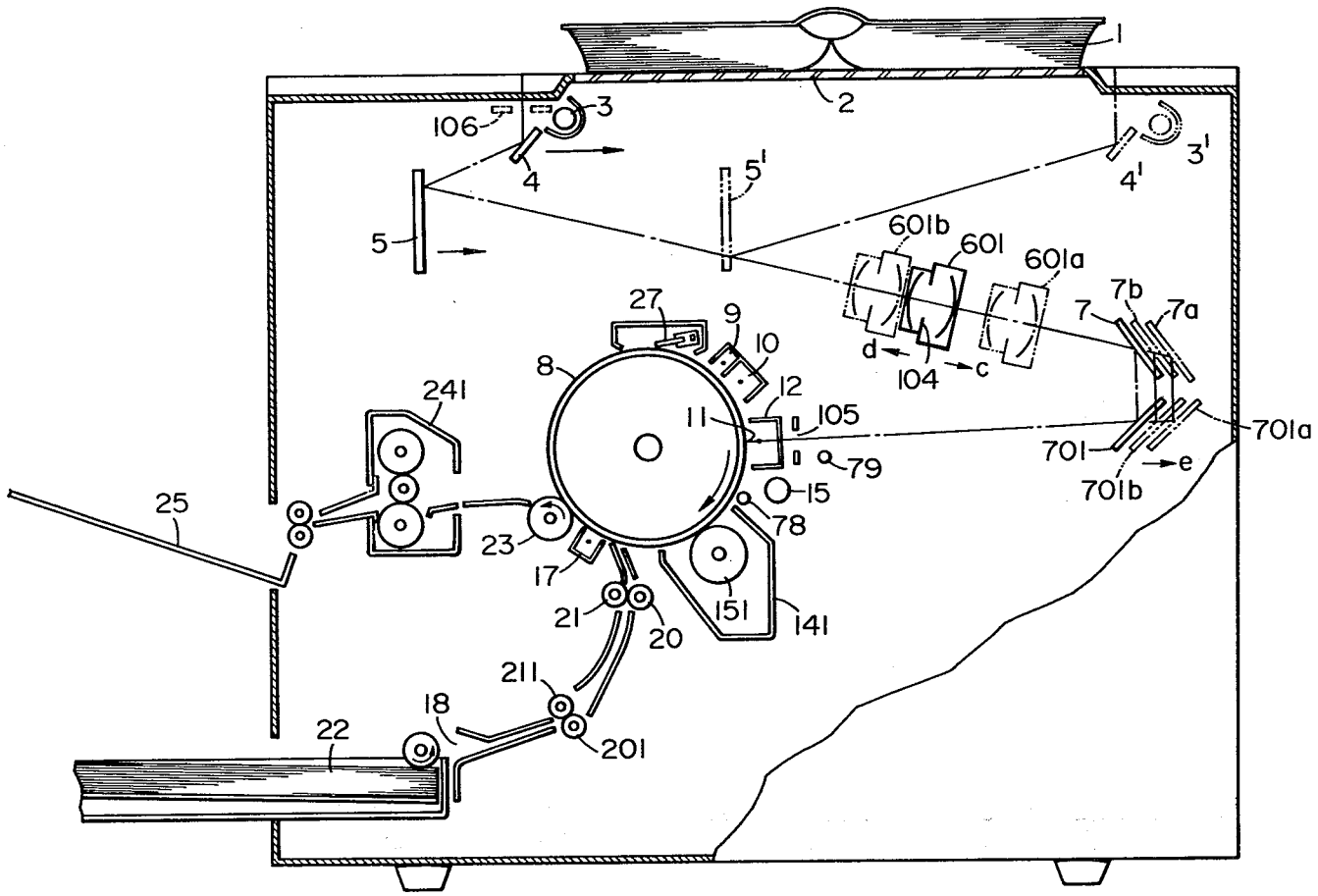
FIG. 10 illustrates another copying apparatus to which the present invention is applicable.

In FIG. 10, means and members similar in construction and function to those shown in FIG. 1 are given similar reference characters. The embodiment of FIG. 10 differs from the embodiment of FIG. 1 in that a through lens 601 is used as the image forming lens and this lens 601 is displaced along the optical path to thereby change the projection magnification of the original image, that reflecting means disposed behind the lens and normally fixed but displaceable by magnification changing operation to change the length of the optical path comprises two mirrors 7 and 701, that a developing device 141 provided with a developing electrode 151 is a dry type developing device, that copy paper conveyor rollers 201 and 211 are added and that a fixing device 241 is of the heat roller type.

Designated by 104 is an iris diaphragm provided in a lens 61. This diaphragm 104 may be disposed before or behind and in proximity to the lens 601. Denoted by 105 is an optical slit provided in proximity to photosensitive member 8. The quantity of light emitted from lamp 3 or the amount of opening of the slit 105 is arbitrarily adjustable by the operator from outside of the apparatus by adopting well-known adjust means in the one-to-one magnification copying apparatus. In any case, an image density desired by the operator can thus be obtained. The quantity of light emitted from the lamp 3 and the amount of opening of the diaphragm 104 or the slit 105 are variable by the operator's operation, but neither of them is varied by the magnification changing operation. Also, the angle at which the original is illuminated by the lamp 3 is the same for any copying magnification.

Lens 6 and mirrors 7 and 701 lie at solid-line positions during the one-to-one magnification copying, lie at positions 6*a*, 7*a* and 701*a* during the reduced-scale copying, and lie at positions 6*b*, 7*b* and 701*b* during the enlarged-scale copying.

When the magnification is m (m=1 is the one-to-one magnification, m<1 is the reduced-scale, and m>1 is the enlarged scale), the illumination $E_{(m)}$ on the photosensitive member is expressed by $$E_{(m)}=A/(1+m)^2 \tag{1}$$

where A is a constant determined by the brightness of the lamp, the type of the original, the transmission factor of the image forming lens, etc.

If the illumination on the photosensitive member at the exposure station 11 during the one-to-one magnification copying is $E_{(l)}$, the following relation is established:

$$\frac{E_{(m)}}{E_{(1)}}=\frac{\dfrac{A}{(1+m)^2}}{\dfrac{A}{(1+1)^2}}=\frac{A}{(1+m)^2} \tag{2}$$

On the other hand, the exposure amount onto the photosensitive member must be made constant both during the one-to-one magnification and the changed magnification copying and therefore, it the width of the light illumination onto the photosensitive member with respect to the direction of movement of the photosensitive member during the changed magnification copying is $W_{(m)}$ and the width of said illumination during the one-to-one magnification copying is $W_{(l)}$ and the peripheral velocity of the photosensitive member during the changed magnification copying is $V_{(m)}$ and the peripheral velocity thereof during the one-to-one magnification copying is $V_{(l)}$, then the following relation is established:

$$(E_{(m)}\cdot W_{(m)})/V_{(m)}=(E_{(l)}\cdot W_{(l)})/V_{(l)} \tag{3}$$

Incidentally, in said optical system, the exposure slit 105 is disposed near the photosensitive member and the amount of opening thereof is always constant and so, $$W_{(m)}=W_{(l)} \tag{4}$$

and if the peripheral velocity $V_{(m)}$ of the photosensitive member during the changed magnification copying is sought after by substituting equations (2) and (4) for equation (3), $$V_{(m)} = \frac{E_{(m)}}{E_{(1)}} \cdot \frac{W_{(m)}}{W_{(1)}} \cdot V_{(1)} = \frac{4}{(1+m)^2} \cdot V_{(1)} \quad (5)$$

That is, when the magnification is m, if the photosensitive member is rotated at a peripheral velocity $4/(1+m)^2$ times the peripheral velocity of the photosensitive member during the one-to-one magnification copying, there is obtained the same exposure amount as that during the one-to-one magnification copying.

In order that the magnification of the image with respect to the direction of rotation of the photosensitive member may be m, the first mirror 3 must be moved forward at a velocity of $\frac{1}{3}$ of the peripheral velocity of the photosensitive member during the magnification m copying and therefore, if the movement velocity of the first mirror (in other words, the original scanning velocity) is $U_{(m)}$, $$U_{(m)} = \frac{1}{m} \cdot V_{(m)} = \frac{4}{m(1+m)^2} \cdot V_{(1)} \quad (6)$$

The forward movement velocity $U_{(1)}$ of the mirror 4 during the one-to-one magnification copying is $$U_{(11)} = 1/1 \times V_{(1)} = V_{(1)} \ldots \quad (7)$$

As seen from equations (5), (6) and (7), if the copying magnification differs, the velocity of the photosensitive member also differs. In the above-described apparatus, when $m>1$, $U_{(m)}$, $V_{(m)} < U_{(1)}$. Accordingly, the above-described embodiment is very useful for a copying apparatus in which enlarged-scale copying can be effected.

In FIG. 10, a slit 106 may be used instead of the slit 105. This slit 106 is movable forward and backward with mirror 4 and lamp 3. Accordingly, the slit 106 is moved forward and backward while being in proximity to the original table 6 and, by the lens, the image of that slit is projected upon the surface of the photosensitive member at the exposure station 11. This slit image performs a function optically equivalent to the slit 105.

In this case, if the magnification is m and the illumination on the photosensitive member is $E_{(m)}$, the following relation is established like the aforementioned equation (1):

$$E_{(m)} = A/(1+m)^2 \ldots \quad (1'),$$

where A is the same constant as that described previously.

Also, if the illumination on the photosensitive member during the one-to-one magnification is $E_{(1)}$, the following relation is established like the aforementioned equation (2):

$$E_{(m)}/E_{(1)} = 4/(1+m)^2 \ldots \quad (2')$$

In the present embodiment, the exposure slit 106 is disposed near the original and therefore, the width of the light illumination on the photosensitive member with respect to the direction of movement of the photosensitive member is varied by the magnification m.

When the magnification is m, if the width of the light illumination of the original with respect to the original scanning direction is $W_{(1)}$ and the width of the light illumination of the photosensitive member with respect to the direction of movement of the photosensitive member is $W_{(m)}$, then $$W_{(m)} = m.W_{(1)} \ldots \quad (3')$$

On the other hand, the exposure amount onto the photosensitive member must be made constant both during the one-to-one magnification copying and the changed magnification copying and therefore, if the peripheral velocity of the photosensitive member during the changed magnification copying is $V_{(m)}$ and that during the one-to-one magnification copying is $V_{(1)}$, the following relation is established:

$$(E_{(m)} \cdot W_{(m)})/V_{(m)} = (E_{(1)} \cdot W_{(1)})/V_{(1)} \ldots \quad (4')$$

If the peripheral velocity $V_{(m)}$ of the photosensitive member during the changed magnification copying is sought after by substituting equations (2') and (3') for equation (4'), $$V_{(m)} = \frac{E_{(m)}}{E_{(1)}} \cdot \frac{W_{(m)}}{W_{(1)}} \cdot V_{(1)} = \frac{4m}{(1+m)^2} \cdot V_{(1)} \quad (5')$$

That is, when the magnification is m, if the photosensitive member is rotated at a peripheral velocity $4m/(1+m)^2$ times the peripheral velocity of the photosensitive member during the one-to-one magnification copying, there is obtained the same exposure amount as that during the one-to-one magnification copying.

If the forward movement velocity of the first mirror 3 is $U_{(m)}$, it becomes as follows:

$$U_{(m)} = \frac{1}{m} \cdot V_{(m)} = \frac{4}{(1+m)^2} \cdot V_{(1)} \quad (6')$$

During the one-to-one magnification copying, $$U_{(1)} = 1/1 \times V_{(1)} = V_{(1)} \ldots \quad (7')$$

As seen from equations (5'), (6') and (7'), if the copying magnification differs, the velocity of the photosensitive member also differs. When $m>1$, both $U_{(m)}$ and $V_{(m)}$ are less than $V_{(1)}$ and therefore, the above-described embodiment is particularly useful for an apparatus in which enlarged-scale copying can be effected.

In any case, in the embodiment described in connection with FIG. 10, even if the light-emitting capability of the lamp 3 and the openings of the diaphragm 104 and slit 105 or 106 are determined with the one-to-one magnification copying as the standard, no complicated adjust means is required and therefore, accurate and reasonable correction of the exposure amount is possible for any copying magnification.

Figure 11:
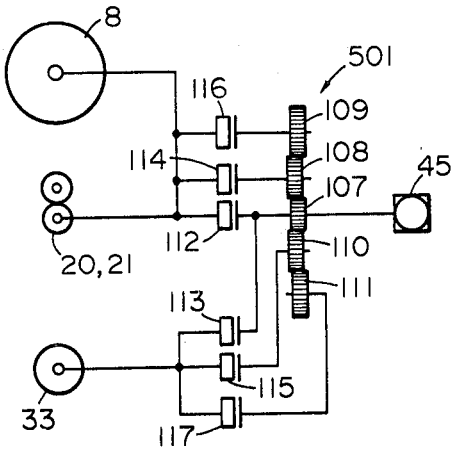
FIG. 11 illustrates another example of the velocity change-over mechanism.

FIG. 11 shows the driving mechanism of the FIG. 10 apparatus. Mirrors 4 and 5 are moved foward and backward by the means of FIG. 2. In FIG. 11, speed changing mechanism 501 is a gear train comprising gears 107–111.

During the one-to-one magnification copying, clutches 112 and 113 are operated to transmit the rotative drive from the motor 45 to the drum 8, copy paper conveyor rollers 20, 21 and pulley 33. By this, the means 8, 20, 21 and 33 are rotated at the same peripheral velocity. During the reduced-scale copying, clutches 114 and 115 are operated. At this time, the rotative drive of the motor 45 is transmitted to the drum 8 and rollers 20, 21 through the gears 107, 108 and clutch 114 and also to the pulley 33 through the gears 107, 110 and clutch 115. During the enlarged-scale copying, clutches 116 and 117 are operated. Accordingly, the rotative drive of the motor 45 is transmitted to the drum 8 and rollers 20, 21 through the gears 107, 108, 109 and clutch 116 and also to the pulley 33 through the gears 107, 110, 111 and clutch 117. The number of teeth of each gear 107–111 is set so that the aforementioned equations (5) and (6) or (5') and (6') are established.

Now, in the first one of the two embodiments described in connection with FIG. 10, during the reduced-scale copying, both the velocity of the photosensitive member and the original scanning velocity are greater than $V_{(1)}$ $(=U_{(1)})$ and, in the second one, during the reduced-scale copying, the original scanning velocity is greater than $V_{(1)}$ $(=U_{(1)})$. However, where a copying apparatus is constructed with the mechanical rigidity, the antivibration property, the capability of the lamp, the discharging capabilities of the dischargers, etc. required for the one-to-one magnification copying being taken as the standard, it is desirable that the original scanning velocity and the velocity of the photosensitive member be less than $V_{(1)}$ $(=U_{(1)})$ both during the enlarged-scale copying and the reduced-scale copying. In the apparatus of FIG. 10, this is achieved by constructing the power transmission mechanism to the drum 8, rollers 20, 21 and pulley 33 as shown in FIG. 12.

Figure 12:
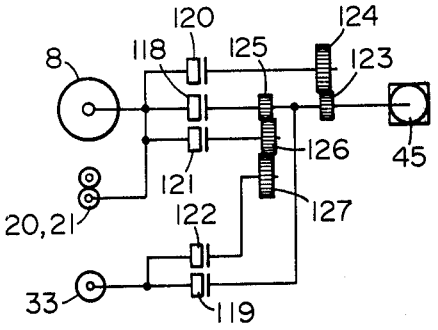
FIG. 12 illustrates still another example of the velocity change-over mechanism.

In FIG. 12, clutches 118 and 119 are operated during the one-to-one magnification copying. The rotative drive of motor 45 is transmitted to the drum 8 and rollers 20, 21 through the clutch 118 and also to the pulley 33 through the clutch 119. By this, the drum 8, rollers 20, 21 and pulley 33 are rotated at the same peripheral velocity $V_{(1)}$ $(=U_{(1)})$.

During the reduced-scale copying, clutches 120 and 119 are operated. By the operation of the clutch 120, the rotative drive of the motor 45 is transmitted to the drum 8 and rollers 20, 21 through speed changing gears 123, 124 and the clutch 120. The rotative drive of the motor 45 is also transmitted to the pulley 33 through the clutch 119. Accordingly, the pulley 33 is rotated at the same peripheral velocity as that during the one-to-one magnification copying. In other words, the original scanning velocity is the same both during the one-to-one magnification copying and the reduced-scale copying. On the other hand, the number of teeth of gear 123, 124 is set so that the peripheral velocity of the drum 8 and rollers 20, 21 is $m_1.V_{(1)}$, where $m_1$ is the copying magnification and is less than 1. During the $m_2$ magnification $(m_2>1)$ enlarge-scale copying, clutches 121 and 122 are operated. Accordingly, the rotative drive of the motor 45 is transmitted to the drum 8 and rollers 20, 21 through speed changing gears 125, 126 and the clutch 121, and the rotative drive of the motor 45 is also transmitted to the pulley 33 through speed changing gears 125, 126, 127 and the clutch 122. The peripheral velocity $V_{(m2)}$ of the drum 8 and rollers 20, 21 and the peripheral velocity $U_{(m2)}$ of the pulley 33 at this time may be determined in accordance with the aforementioned equations (5) and (6) or (5') and (6'). That is, in a copying apparatus using the slit 105, $V_{(m2)}$ and $U_{(m2)}$ are determined in accordance with equations (5) and (6) and the number of teeth of gears 125, 126, 127 is set so that these equations (5) and (6) are established. On the other hand, in a copying apparatus using the slit 106, $V_{(m2)}$ and $U_{(m2)}$ are determined in accordance with equations (5') and (6') and the number of teeth of gears 125, 126, 127 is set so that these equations (5') and (6') are established.

The correction of the exposure amount of the photosensitive member accompanying the change-over between the one-to-one magnification copying and the reduced-scale copying can be accomplished by adjusting one of the quantity of light emitted from the lamp 3, the amount of opening of the diaphragm 104 and the amount of opening of the slit 105 or 106. Whichever may be adjusted, the adjustment should only be effected so that the exposure amount for the reduced-scale copying is smaller than that for the one-to-one magnification copying and therefore, the optical adverse effect by such adjustment can be minimized. On the other hand, the correction of the exposure amount of the photosensitive member accompanying the change-over between the one-to-one magnification copying and the enlarged-scale copying can be accomplished by changing the velocity of the photosensitive member to the velocity represented by equation (5) or (5'). Accordingly, in this case, any of the quantity of light emitted from the lamp 3, the amount of opening of the diaphragm 103 and the amount of opening of the slit 105 or 106 need not be changed by the magnification changing operation.

In any case, both during the reduced-scale copying and the enlarged-scale copying, the velocity of the photosensitive member is less than during the one-to-one magnification copying. The original scanning velocity during the reduced-scale copying is the same as that during the one-to-one magnification copying, and the original scanning velocity during the enlarged-scale copying is less than that during the one-to-one magnification copying. Accordingly, by constructing the apparatus with the mechanical, electrical and physical requirements for the one-to-one magnification copying being taken as the standard, the reduced-scale and enlarged-scale copying functions can be added reasonably.

In FIGS. 11 and 12, the lines passing through the numbered means and members represent the power transmission mechanism such as gear train, chain, sprocket, etc.

Figure 13:
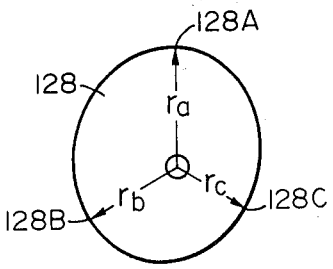
FIG. 13 illustrates another example of the cam of FIG. 4.

Again in the foregoing three embodiments described in connection with FIG. 10, the light portion potential and dark portion potential of the electrostatic image can be maintained substantially constant for any copying magnification by varying the quantities of discharge per unit time of the dischargers 10 and 12 correspondingly to the variation in velocity of the photosensitive member resulting from the change of the magnification. As the means for controlling the quantities of discharge, use may be made of means similar to that described in connection with FIGS. 4 to 9. However, in the three embodiments described in connection with FIG. 10, three different copying magnifications can be selected and accordingly, three different velocities of the photosensitive member can be selected. Therefore, the quantities of discharge of the dischargers must be varied in three stages. Accordingly, where the device of FIG. 4 is used in the apparatus of FIG. 10, the cams 57 and 58 is replaced by a cam 128 having three cam surfaces 128A, 128B and 128C as shown in FIG. 13. The distances $r_a$, $r_b$ and $r_c$ between the cam surfaces 128A, 128B, 128C and the axis of rotation are in the relation that $r_a > r_b > r_c$. Assume that the velocity of the photosensitive member has been changed to V, V', V'' (V>V'>V'') correspondingly to the selected magnification. When the velocity of the photosensitive member is V, the cam surface 128A is caused to bear against adjust members 51 and 52, and when the velocity of the photosensitive member is V', the cam surface 128B is caused to bear against the adjust members 51 and 52, and when the velocity of the photosensitive member is V'', the cam surface 128C is caused to bear against the adjust members 51 and 52.

Figure 14:
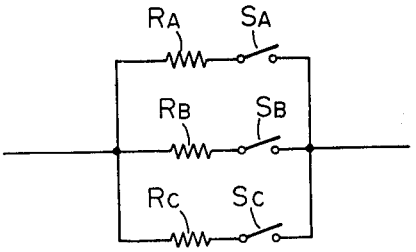
FIG. 14 illustrates essential portions of a modification of the change-over means shown in FIGS. 5, 6 and 7.

As the bias change-over means disposed between the grids 10'', 12'' and the bias voltage sources 64, 65 of FIG. 5, or the electrode voltage change-over means disposed between the electrodes 10', 12' and the power sources 71, 72 of FIG. 6, or the change-over means disposed between the input terminals and output terminals of the operational amplifier $O_1$ and $O_2$ of FIG. 7 and parallel to the amplifiers $O_1$ and $O_2$, use may be made of the means shown in FIG. 14. The resistance values of resistors $R_A$, $R_B$ and $R_C$ are in the relation that $R_A > R_B > R_C$. Where the means of FIG. 14 is applied to the device of FIG. 5 or 7, switch $S_A$ is closed when the velocity of the photosensitive member is V, and switch $S_B$ is closed when the velocity of the photosensitive member is V', and switch $S_C$ is closed when the velocity of the photosensitive member is V''. Where the means of FIG. 14 is applied to the device of FIG. 6, switch $S_C$ is closed when the velocity of the photosensitive member is V, and switch $S_B$ is closed when the velocity of the photosensitive member is V', and switch $S_A$ is closed when the velocity of the photosensitive member is V''. Also, where the control device of FIG. 9 is applied to the apparatus of FIG. 10, the target potential standard signal generated by means 100 may be changed over into three stages.

In each of the embodiments described above in connection with FIG. 10, design may also be made such that four or more kinds of copying magnification can be selected. It is also possible to use the means 78, 83, 97 and 98 of FIG. 7 to control the development bias applied to the developing electrode 151.

The present invention is also applicable to electrophotographic copying apparatus using an electrophotographic photosensitive member not having a transparent insulating layer on the surface thereof, namely, a two-layer photosensitive member comprising a photoconductive layer disposed on an electrically conductive layer. In this case, the discharger 12 and lamp 13 used in the above-described embodiments would be unnecessary. Accordingly, the above-described means for changing the quantity of discharge of the discharger 12 would of course be unnecessary.

The present invention is also applicable to copying apparatus of the type in which the original table supporting an original thereon is moved forward and backward and during the forward movement thereof, the original is scanned. In this case, the velocity of forward movement of the original table would be the original scanning velocity.

What we claim is:

1. An electrophotographic apparatus capable of copying an original selectively at different magnifications, comprising:

a movable electrophotographic photosensitive member;

discharge means for imparting discharge to said photosensitive member to render said photosensitive member into a potential condition capable of forming an electrostatic latent image;

scanning means for scanning said original;

optical means for forming an optical image of said scanned orginal on said photosensitive member at a selected magnification to form an electrostatic latent image, said optical means including at least one optical element which is mounted for movement to change the magnification;

photosensitive member velocity changing means for changing the velocity of movement of said photosensitive member in correspondence with the selected magnification; and control means for varying the quantity of discharge per unit time of said discharge means to said photosensitive member in correspondence with the selected magnification;

wherein said photosensitive member moves at the speed $V_1$ when the magnification is $m_1$, said velocity changing means changes the velocity of said photosensitive member to $V_2$, which is smaller than $V_1$, when the magnification is $m_2$, and said control means decreases the quantity of discharge per unit time when the magnification is $m_2$, as compared with the quantity when the magnification is $m_1$.

2. An apparatus according to claim 1, wherein said control means has voltage changing means for changing the voltage applied to said discharge means in correspondence with the selected magnification.

3. An apparatus according to claim 1, wherein said control means includes distance changing means for changing the distance between said photosensitive member and said discharge means in correspondence with the selected magnification.

4. An apparatus according to claim 1, further comprising:

detector means for detecting the surface potential of said photosensitive member; and adjusting means responsive to said detector means to adjust the quantity of discharge per unit time of said discharge means.

5. An apparatus according to claim 4, wherein said control means includes means for varying the output of said adjusting means in correspondence with the selected magnification.

6. An apparatus according to claim 4 or 5, further comprising:

developing means for developing the electrostatic latent image formed on said photosensitive member, said developing means having a development bias applied thereto; and means responsive to said potential detecting means to adjust said development bias.

7. An apparatus according to any one of claims 1 to 5, wherein said scanning means scans the original at the same scanning velocity U both for the copying at the magnification $m_1$ and the copying at the magnification $m_2$, and said photosensitive member moves at velocities $m_1U$ and $m_2U$ for the copying at the magnification $m_1$ and the copying at the magnification $m_2$, respectively.

8. An apparatus according to claim 7, wherein $m_1=1$ and $m_2<m_1$.

9. An apparatus according to any one of claims 1-5, wherein said control means changes the quantity of discharge, in correspondence with the selected magnification, so that the potentials of the light and dark portions of the latent image are maintained substantially constant irrespective of the magnification.

10. An electrophotographic apparatus capable of copying an original selectively at different magnifications, comprising:

an electrophotographic photosensitive member movable at speed $V_1$ when the magnification is $m_1$, and at speed $V_2$ when the magnification is $m_2$, wherein $V_2$ is smaller than $V_1$;

discharging means for imparting a discharge to said photosensitive member to provide said photosensitive member with a potential condition for forming an electrostatic latent image;

scanning means for scanning said original at a speed obtained by multiplying the speed of the photosensitive member by a reciprocal of the magnification;

optical means for forming an optical image of said scanned original on said photosensitive member at a selected magnification to form an electrostatic latent image, said optical means including at least one optical element movable to change the magnification;

means for controlling the voltage applied to said discharging means to control the quantity of discharge per unit time of said discharging means in accordance with the selected magnification.

11. An apparatus according to claim 10, wherein said discharge means includes an electrode, and said control means controls the voltage applied to the electrode in accordance with the selected magnification.

12. An apparatus according to claim 10, wherein said discharging means includes a discharging electrode and grid, and wherein said control means controls the voltage applied to the grid in accordance with the selected magnification.

13. An apparatus according to claim 10, further comprising:

detector means for detecting the surface potential of said photosensitive member; and adjusting means responsive to said detector means to adjust the quantity of discharge per unit time of said discharging means.

14. An apparatus according to claim 13, wherein said control means has means for varying the output of said adjusting means in correspondence with the selected magnification.

15. An apparatus according to anyone of claim 10 to 14 wherein said control means decreases the quantity of discharge when the magnification is $m_2$, as compared with the quantity when the magnification is $m_1$.

16. An apparatus according to claim 15, further comprising:

developing means for developing the electrostatic latent image formed on said photosensitive member to form a developed image;

means for transferring the developed image onto a transfer material; and means for transporting a transfer material to said photosensitive member at a speed equal to the speed of the photosensitive member.

17. An apparatus according to claim 16, wherein said photosensitive member and said transporting means are driven by a common driving source, and the driving force from the driving source is transmitted to said photosensitive member and said transporting means through a common speed changing means.

18. An apparatus according to claim 16, further comprising, means for controlling the development bias applied to the developing means in accordance with the surface potential of the photsensitive member.

19. An apparatus according to claim 16, wherein said control means controls the quantity of discharge per unit time, in correspondence with the selected magnification, so that the potentials of the light and dark portions of the latent image are maintained substantially constant irrespective of the magnification.

20. An apparatus according to claim 16, further comprising, means for changing the scanning velocity of the scanning means in correspondence with the selected magnification, wherein said scanning means scans the original at scanning velocities $U_1$ and $U_2$ ($U_1 \neq U_2$) for magnification $m_1$ and magnification $m_2$, respectively, and said photosensitive member moves at velocities $m_1U_1$ and $m_2U_2$ ($m_1U_1 \neq m_2U_2$, $V_1=m_1U_1$, $V_2=m_2U_2$) for magnification $m_1$ and magnification $m_2$, respectively.

21. An apparatus according to claim 20, further including driving means for said photosensitive member, wherein said photosensitive member driving means changes the velocity of movement of said photosensitive member so that the exposure amount of said photosensitive member is maintained substantially constant for a change in scanning velocity of said scanning means.

22. An apparatus according to claim 20, wherein said control means controls the quantity of discharge per unit time, in correspondence with the selected magnification, so that the potentials of the light and dark portions of the latent image are maintained substantially constant irrespecive of the magnification.

23. An apparatus according to claim 20, further comprising; means for controlling the development bias applied to the developing means in accordance with the surface potential of the photosensitive member.

24. An apparatus according to claim 16, further comprising:

means for changing the light quantity of the optical image in correspondence with the selected magnification to maintain an amount of exposure of said photosensitive member substantially constant irrespective of the change in the photosensitive member velocity.

25. An apparatus according to claim 24, wherein said light quantity changing means includes means for illuminating the original.

26. An apparatus according to claim 24, wherein said light quantity changing means includes means for limiting the bundle of the beam disposed across the optical path between the original and said photosensitive member.

27. An apparatus according to claim 24, wherein said light quantity changing means includes a plurality of imaging lenses having different F-numbers.

28. An apparatus according to claim 24, wherein said light quantity changing means decreases the light quantity, when the magnification is $m_2$, as compared with the light quantity when the magnification is $m_1$.

29. An apparatus according to claim 28, wherein said control means controls the quantity of discharge per unit time in correspondence with the selected magnification, so that the potentials of the light and dark portions of the latent image are maintained substantially constant irrespective of the magnification.

30. An apparatus according to claim 24, further comprising, means for controlling the development bias applied to the developing means in accordance with the surface potential of the photosensitive member.

31. An electrophotographic apparatus capable of copying an original selectively at different magnifications, comprising:

a movable electrophotographic photosensitive member;

discharging means for imparting discharge to said photosensitive member to provide said photosensitive member with a potential condition for forming an electrostatic latent image;

scanning means for scanning said original;

optical means for forming an optical image of said scanned original on said photosensitive member at a selected magnification to form an electrostatic latent image, said optical means including at least one optical element movable to change the magnification;

means for driving the photosensitive member at a speed $V_1$ when the magnification is $m_1$, and at a speed $V_2$ when the magnification is $m_2$, wherein $V_1$ is obtained by multiplying the speed of the scanning means when the magnification is $m_1$ by $m_1$, and $V_2$ is obtained by multiplying the speed of the scanning means when the magnification is $m_2$ by $m_2$, wherein $V_2$ is smaller than $V_1$;

control means for controlling the quantity of discharge per unit time of said discharge means, in dependence upon whether the magnification is $m_1$ or $m_2$, said control means controlling the voltage applied to said discharging means to reduce said quantity of discharge per unit time when the magnification is $m_2$ as compared to when it is $m_1$.

32. An apparatus according to claim 31, wherein said discharging means includes a discharging electrode, and said control means changes the voltage applied to the discharging electrode in dependence on whether the magnification is $m_1$ or $m_2$.

33. An apparatus according to claim 31, wherein said discharging means includes a discharge electrode and a grid, and said control means changes the voltage applied to the grid in dependence on whether the magnification is $m_1$ or $m_2$.

34. An apparatus according to claim 31, further comprising:

detector means for detecting the surface potential of said photosensitive member; and adjusting means responsive to said detector means to adjust the quantity of discharge per unit time of said discharging means.

35. An apparatus according to claim 34, wherein said control means includes means for varying the output of said adjusting means in correspondence with the selected magnification.

36. An apparatus according to any one of claims 31–35, further comprising:

developing means for developing the electrostatic latent image formed on said photosensitive member to form a developed image;

means for transferring the developed image onto a transfer material;

means for transporting a transfer material to said photosensitive member at a speed $V_1$ when the magnification is $m_1$, and at a speed $V_2$ when the magnification is $m_2$;

means for changing the light quantity of the optical image in correspondence with the selected magnification to maintain an amount of exposure of said photosensitive member substantially constant irrespective of the change in the photosensitive member velocity.

37. An apparatus according to claim 36, wherein said photosensitive member and said transporting means are driven by a common driving source, and said photosensitive member driving means and the transfer material transporting means use a common speed changing means so that the driving force from the driving source is transmitted to said photosensitive member and said transporting means through said common speed changing means.

38. An apparatus according to claim 36, further comprising, means for controlling the development bias applied to the developing means in accordance with the surface potential of the photosensitive member.

39. An apparatus according to claim 36, wherein said light quantity changing means includes means for illuminating the original.

40. An apparatus according to claim 36, wherein said light quantity changing means includes means for limiting the bundle of the beam disposed across the optical path between the original and said photosensitive member.

41. An apparatus according to claim 36, wherein said light quantity changing means includes a plurality of imaging lenses having different F-numbers.

42. An apparatus according to claim 36, wherein said light quantity changing means reduces the light quantity when the magnification is $m_2$ as compared to when it is $m_1$.

43. An apparatus according to claim 36, wherein said control means controls the quantity of discharge, in correspondence with the selected magnification, so that the potentials of the light and dark portions of the latent image are maintained substantially constant irrespective of the magnification.

44. An apparatus according to claim 43, further comprising, means for changing the scanning velocity of said scanning means in correspondence with the selected magnification, wherein said scanning means scans the original at scanning velocities $U_1$ and $U_2$ ($U_1 \neq U_2$) for magnification $m_1$ and magnification $m_2$, respectively, and said photosensitive member moves at velocities $m_1U_1$ and $m_2U_2$ ($m_1U_1 \neq m_2U_2$, $V_1 = m_1U_1$, $V_2 = m_2U_2$) for magnification $m_1$ and magnification $m_2$, respectively.

45. An electrophotographic apparatus capable of copying an original selectively at different magnifications, comprising:

a movable electrophotographic photosensitive member;

discharging means for imparting discharge to said photosensitive member to provide said photosensitive member with a potential condition for forming an electrostatic latent image;

scanning means for scanning said original;

optical means for forming an optical image of said scanned original on said photosensitive member at a selected magnification to form an electrostatic latent image, said optical means including at least one optical element movable to change the magnification;

means for driving the photosensitive member at a speed $V_1$ when the magnification is $m_1$, and at a speed $V_2$ when the magnification is $m_2$, wherein $V_1$ is obtained by multiplying the speed of the scanning means when the magnification is $m_1$ by $m_1$, and $V_2$ is obtained by multiplying the speed of the scanning means when the magnification is $m_2$ by $m_2$, wherein $V_2$ is smaller than $V_1$;

control means for changing the intensity of the electric field between said discharging means and said photosensitive member in dependence of whether the magnification is $m_1$ or $m_2$, wherein said control means controls the quantity of discharge per unit time of said discharge means so that the potentials of the light and dark portions are constant irrespective of whether the magnification is $m_1$ or $m_2$.

46. An apparatus according to claim 45, wherein said control means has voltage changing means for changing the voltage applied to said discharge means in correspondence with the selected magnification.

47. An apparatus according to claim 45, wherein said control means includes distance changing means for changing the distance between said photosensitive member and said discharge means in correspondence with the selected magnification.

48. An apparatus according to claim 45, further comprising:

detector means for detecting the surface potential of said photosensitive member; and adjusting means responsive to said detector means to adjust the quantity of discharge per unit time of said discharge means.

49. An apparatus according to claim 48, wherein said control means includes means for varying the output of said adjusting means in correspondence with the selected magnification.

50. An apparatus according to any one of claims 45–49, further comprising, developing means for developing the electrostatic latent image formed on said photosensitive member to form a developed image;

means for transferring the developed image onto a transfer material;

means for transporting a transfer material to said photosensitive member, at a speed $V_1$ when the magnification is $m_1$, and at a speed of $V_2$ when the magnification is $m_2$;

means for changing the light quantity of the optical image in correspondence with the selected magnification to maintain an amount of exposure of said photosensitive member substantially constant irrespective of the change in the photosensitive member velocity.

51. An apparatus according to claim 50, wherein said control means decreases the quantity of discharge per unit time when the magnification is $m_2$, as compared with the quantity when the magnification is $m_1$.

52. An apparatus according to claim 51, wherein said photosensitive member and said transporting means are driven by a common driving source, and said photosensitive member driving means and the transfer material transporting means use a common speed changing means so that the driving force from the driving source is transmitted to said photosensitive member and said transporting means through said common speed changing means.

53. An apparatus according to claim 51, further comprising, means for changing the scanning velocity of said scanning means in correspondence with the selected magnification;

wherein said scanning means scans the original at scanning velocities $U_1$ and $U_2$ ($U_1 \neq U_2$) for magnification $m_1$ and magnification $m_2$, respectively, and said photosensitive member moves at velocities $m_1U_1$ and $m_2U_2$ ($m_1U_1 = m_2U_2$, $V_1 \neq m_1U_1$, $V_2 = m_2U_2$) for magnification $m_1$ and magnification $m_2$, respectively.

54. An apparatus according to claim 51, wherein said light quantity changing means decrease the light quantity of the optical image when the magnification is $m_2$, as compared with the quantity when the magnification is $m_1$.

55. An apparatus according to claim 51, further comprising means for detecting the surface potential of the photosensitive member to control the development bias applied to said developing means.

* * * * *

UNITED STATES PATENT AND TRADEMARK OFFICE

CERTIFICATE OF CORRECTION

PATENT NO. : 4,411,514

DATED : October 25, 1983

INVENTOR(S) : SHIGEGIRO KOMORI, ET AL.

It is certified that error appears in the above-identified patent and that said Letters Patent is hereby corrected as shown below:

COLUMN 12

Line 59, "apredetermined" should read --a predetermined--.

CLAIM 15

Line 1, "claim" should read --claims--.

CLAIM 22

Line 6, "irrespecive" to read --irrespective--.

Signed and Sealed this

*Fifth* Day of *June 1984*

[SEAL]

*Attest:*

GERALD J. MOSSINGHOFF

*Attesting Officer*

*Commissioner of Patents and Trademarks*